US011370221B2

(12) United States Patent
Hasebe

(10) Patent No.: US 11,370,221 B2
(45) Date of Patent: Jun. 28, 2022

(54) WIPING DEVICE, HEAD MAINTENANCE DEVICE, AND LIQUID DISCHARGE APPARATUS

(71) Applicant: Ricoh Company, Ltd., Tokyo (JP)

(72) Inventor: Daisuke Hasebe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/195,052

(22) Filed: Mar. 8, 2021

(65) Prior Publication Data

US 2021/0283915 A1 Sep. 16, 2021

(30) Foreign Application Priority Data

Mar. 16, 2020 (JP) ..... JP2020-045717

(51) Int. Cl.
*B41J 2/165* (2006.01)

(52) U.S. Cl.
CPC .... *B41J 2/16544* (2013.01); *B41J 2002/1655* (2013.01)

(58) Field of Classification Search
CPC ..... B41J 2/16544; B41J 2002/1655
See application file for complete search history.

(56) References Cited

U.S. PATENT DOCUMENTS

| | | | | |
|---|---|---|---|---|
| 6,336,401 | B1 | 1/2002 | Hasebe | |
| 6,581,515 | B1 | 6/2003 | Hasebe | |
| 10,543,689 | B2 * | 1/2020 | Hasebe | B41J 2/16535 |
| 2012/0160113 | A1 | 6/2012 | Hasebe | |
| 2019/0184709 | A1 | 6/2019 | Hasebe et al. | |

FOREIGN PATENT DOCUMENTS

| | | |
|---|---|---|
| JP | 2019-107876 | 7/2019 |

* cited by examiner

*Primary Examiner* — Geoffrey S Mruk
(74) *Attorney, Agent, or Firm* — Xsensus LLP

(57) ABSTRACT

A wiping device includes a roll unit, a moving member, processing circuitry, and a groove. The roll unit includes a band-shaped member, a first axial member, and a second axial member. The band-shaped member is wound around the first axial member to form a feed-side roll, and is wound around the second axial member to form a winding-side roll. The first axial member is movable relative to the second axial member. The moving member slides the roll unit. The processing circuitry controls sliding of the roll unit. The groove supports the first axial member at a position substantially horizontally opposed to the second axial member when a diameter of the feed-side roll is equal to or larger than a size, and guides the first axial member so that the first axial member moves upward and farther away from the second axial member as the diameter of the feed-side roll decreases.

8 Claims, 13 Drawing Sheets

FIG. 15

| NO | pps | rpm | mm/s |
|---|---|---|---|
| 1 | 200 | 250 | 50 |
| 2 | 240 | 300 | 60 |
| 3 | 280 | 350 | 70 |
| 4 | 320 | 400 | 80 |
| 5 | 400 | 500 | 100 |
| 6 | 480 | 600 | 120 |
| 7 | 520 | 650 | 130 |
| 8 | 600 | 750 | 150 |

WIPING DEVICE, HEAD MAINTENANCE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-045717, filed on Mar. 16, 2020, in the Japan Patent Office, the entire disclosure of which is incorporated by reference herein.

BACKGROUND

Technical Field

Aspects of the present disclosure relate to a wiping device, a head maintenance device, and a liquid discharge apparatus.

Related Art

There is known a maintenance-and-recovery mechanism (or a maintenance device) that includes a cap to cap a nozzle surface of a liquid discharge head in a liquid discharge apparatus and a wiping device to wipe and clean the nozzle surface to maintain and regularly recover the condition of the liquid discharge head. Further, there is known a liquid discharge apparatus including the maintenance device.

SUMMARY

In an aspect of the present disclosure, there is provided a wiping device that includes a roll unit, a moving member, processing circuitry, and a groove. The roll unit includes a band-shaped member, a first axial member, and a second axial member. The band-shaped member is wound around the first axial member in a roll shape to form a feed-side roll. The band-shaped member is fed from the feed-side roll, and is wound around the second axial member in a roll shape to form a winding-side roll. The first axial member is movable relative to the second axial member. The moving member slides the roll unit. The processing circuitry controls sliding of the roll unit. The groove supports the first axial member at a position substantially horizontally opposed to the second axial member when a diameter of the feed-side roll is equal to or larger than a size, and guides the first axial member so that the first axial member moves upward and farther away from the second axial member as the diameter of the feed-side roll decreases from the size.

In another aspect of the present disclosure, there is provided a head maintenance device that includes the wiping device to wipe a nozzle surface of the liquid discharge head.

In still another aspect of the present disclosure, there is provided a liquid discharge apparatus that includes the head maintenance device.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 15 is a table illustrating an example of a moving speed in the wiping cartridge of FIG. 3.

Figure 1:
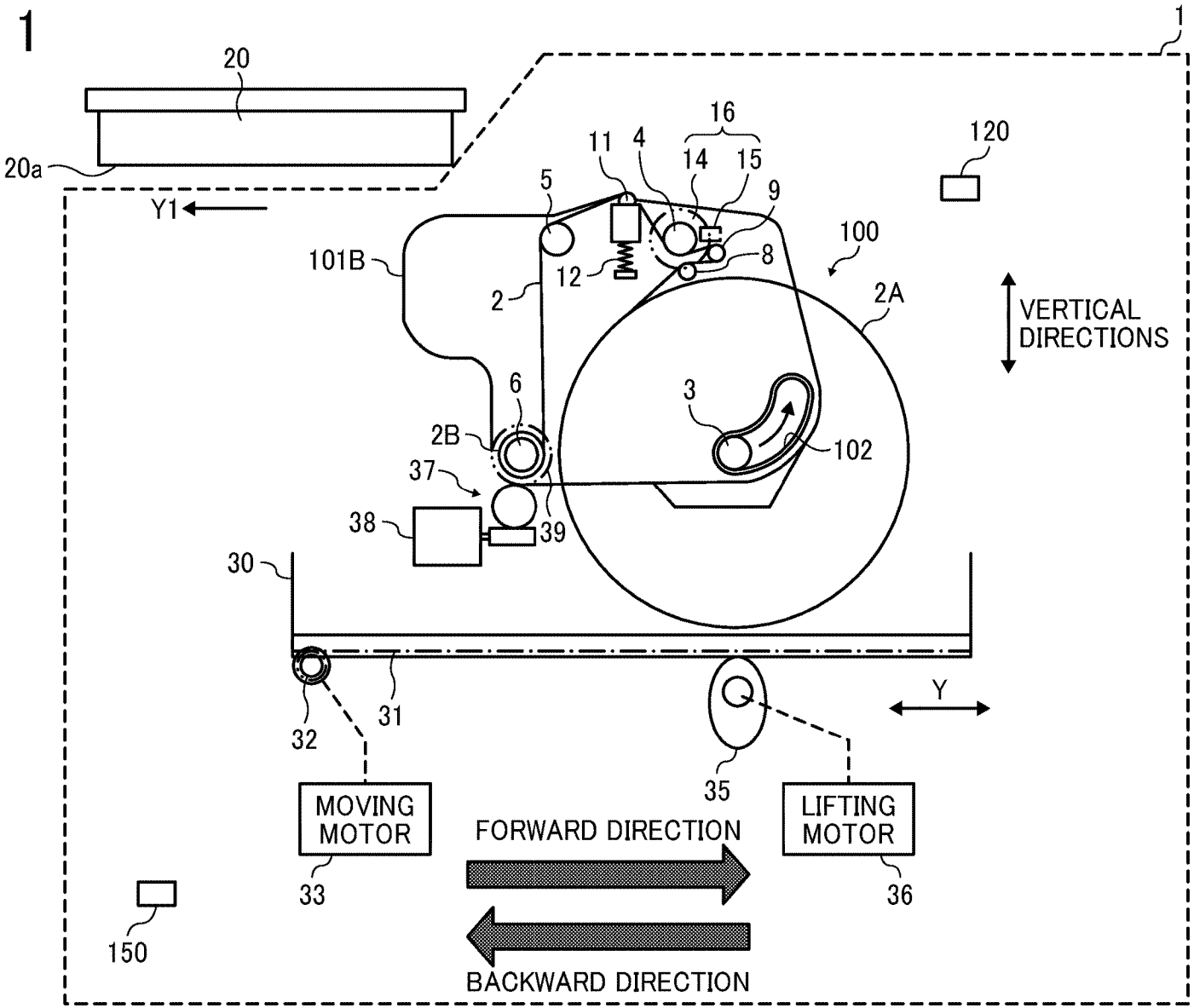
FIG. 1 is a side view of a wiping device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a side view of a wiping device 1 including a wiping cartridge 100 as a roll unit according to an embodiment of the present disclosure. As illustrated in FIG. 1, the wiping device 1 wipes, as an object to be wiped, a nozzle surface 20*a* of a liquid discharge head (hereinafter referred to as "head") 20 provided in a liquid discharge apparatus. The liquid discharge head 20 includes a plurality of nozzles to discharge liquid.

A wiping cartridge 100 that rolls and holds a web 2 is detachably attached on a moving member 30. The web 2 is a band-shaped member to wipe the nozzle surface 20*a* and serves as a wiping member of a sheet shape. Note that the wiping cartridge 100 corresponds to a wiping unit.

The moving member 30 includes a transmission mechanism 37 and a winding motor 38. The transmission mechanism 37 meshes with a gear 39 provided on a winding roller 6 that is an axial member of a winding-side roll 2B that winds up the web 2 fed from a feed-side roll 2A when the wiping cartridge 100 is attached. The winding motor 38 rotates the winding roller 6 via the transmission mechanism 37.

Further, the moving member 30 is provided with an encoder sensor 15 composed of a transmissive photosensor that detects a pattern formed on a code wheel 14 of the wiping cartridge 100. The code wheel 14 and the encoder sensor 15 constitute an encoder 16 to detect a moving distance (feed amount) of the web 2.

The moving member 30 is disposed so as to be reciprocatingly movable in a direction indicated by arrow Yin FIG. 1, which is a nozzle array direction of the liquid discharge head 20. The moving member 30 is moved in a wiping direction Y1 (backward direction) by a moving mechanism including a rack 31, a pinion 32, and a moving motor 33 that rotates the pinion 32.

The moving member 30 is disposed so as to be movable in the vertical direction (liftable) in which the web 2 moves forward and backward with respect to the nozzle surface 20*a*. The moving member 30 is lifted by, for example, a cam 35 and a lifting mechanism that includes a moving-member lifting motor 36 to rotate the cam 35.

The wiping operation of the wiping device 1 is described below. When the wiping device 1 wipes the nozzle surface 20*a* of the liquid discharge head 20, the moving member 30 rises to press the web 2 against one end of the nozzle surface 20*a* of the liquid discharge head 20 with a predetermined pressing force.

Then, when the moving member 30 is moved in the wiping direction (Y1 direction), the web 2 wipes and absorbs the liquid (waste liquid) remaining on the nozzle surface 20*a* to remove the remaining liquid.

Thereafter, or before the next wiping operation, the winding roller 6 is rotated to wind up the web 2 on the winding-side roll 2B so that an unused portion of the web 2 can contact the nozzle surface 20*a* when the next wiping is performed. Further, the wiping operation can be performed while rotating the winding roller 6 to wind the web 2 on the winding-side roll 2B. In other words, the wiping operation can also be performed while feeding the web 2.

Control Configuration of Wiping Device 1

Figure 2:
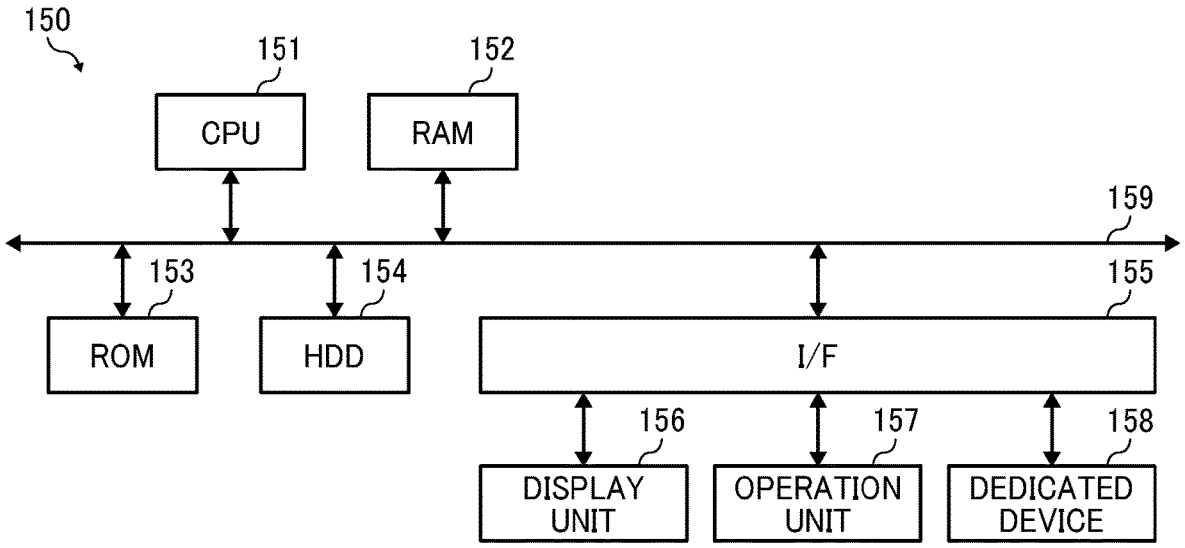
FIG. 2 is a schematic view illustrating the configuration of a controller of a wiping device according to an embodiment of the present disclosure.

Next, a control configuration of a wiping operation of the wiping cartridge 100 in the wiping device 1 is described below. The wiping device 1 includes a controller 150 as a control device. FIG. 2 is a diagram illustrating a hardware configuration of the controller 150. As illustrated in FIG. 2, the controller 150 includes a configuration similar to a controller of a general information processing device, and controls the operation of each configuration of the wiping device 1 according to the present embodiment.

The controller 150 includes a central processing unit (CPU) 151, a random access memory (RAM) 152, a read only memory (ROM) 153, a hard disk drive (HDD) 154, and an interface (I/F) 155 that are connected to each other via a bus 159. A display unit 156, an operation unit 157, and a dedicated device 158 are connected to the I/F 155.

The CPU 151 is a computing unit and controls overall operation of the wiping device 1. The RAM 152 is a volatile storage medium that allows data to be read and written at high speed and used as a working area when the CPU 151 processes data. The ROM 153 is a read only non-volatile storage medium and stores programs such as firmware. The HDD 154 is a non-volatile storage medium that allows data to be read or written. The HDD 154 stores, e.g., an operation system (OS) for operating the wiping device 1, various control programs and application programs for movement control of the wiping cartridge 100 by the wiping device 1, and application programs. Since the controller 150 may be provided with a non-volatile storage medium, such a storage medium is not limited to a medium that records data on metal with magnetic material added, such as HDD 154.

The I/F 155 connects the bus 159 to various hardware components or networks for control. The display unit 156 is a visual user interface through which a user checks the status and the setting of the operating mode of the wiping device 1. The display unit 156 includes a display unit such as a liquid crystal display (LCD). The operation unit 157 is a user interface for inputting the setting related to the control operation of the wiping device 1.

The dedicated device 158 is a hardware for realizing a function dedicated to the wiping device 1, and includes, for example, an image-forming processing function of the image forming unit 110. Further, the dedicated device 158 includes the encoder 16 and a humidity sensor 120.

The controller 150 constitutes a software controller that uses each hardware configuration included in the dedicated device 158, reads out a program stored in the ROM 153, the HDD 154, and so forth into the RAM 152, and executes the program by the CPU 151 to achieve a predetermined function.

The wiping operation by the wiping device 1 is controlled by the controller 150 described above. For example, the controller 150 accepts input from the encoder sensor 15, which consists of a transmissive photo sensor installed in the moving member 30, and detects the moving distance (feed amount) of the web 2 in response to the input. The controller 150 controls the movement and stop of the wiping cartridge 100 based on the detected moving distance.

Further, the controller 150 controls acceleration of the wiping cartridge 100 at the time of movement and stop. In this specification, the acceleration at the time of stopping may also be referred to as "deceleration" because the acceleration is a negative acceleration.

The controller 150 controls the acceleration (deceleration) of the wiping cartridge 100 based on the speed (moving speed) of the wiping cartridge 100. The controller 150 changes the moving speed and acceleration (deceleration) of the wiping cartridge 100 according to the residual amount (mass or diameter) of the web 2 provided with the wiping cartridge 100. The controller 150 changes the moving speed and acceleration (deceleration) according to the moving direction of the wiping cartridge 100.

The controller 150 measures the ambient temperature and humidity of the wiping cartridge 100 with the humidity sensor 120, and changes the moving speed and acceleration (deceleration) according to the measurement result.

Description of Web Slack in Present Embodiment

Figure 3:
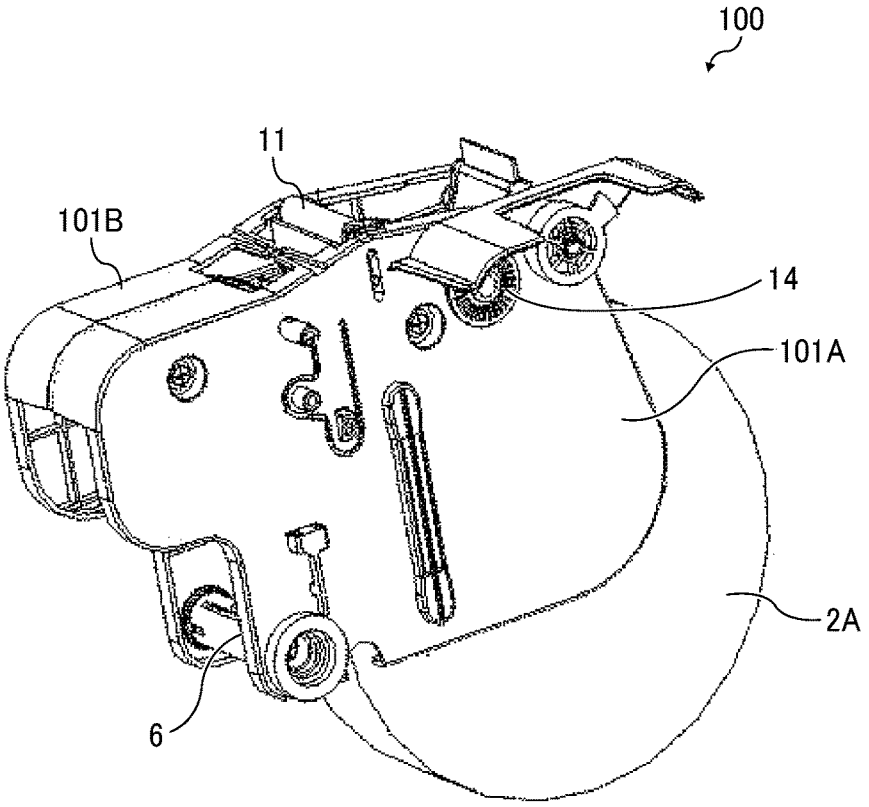
FIG. 3 is an external perspective view of a wiping cartridge according to an embodiment of the present disclosure.
Figure 4:
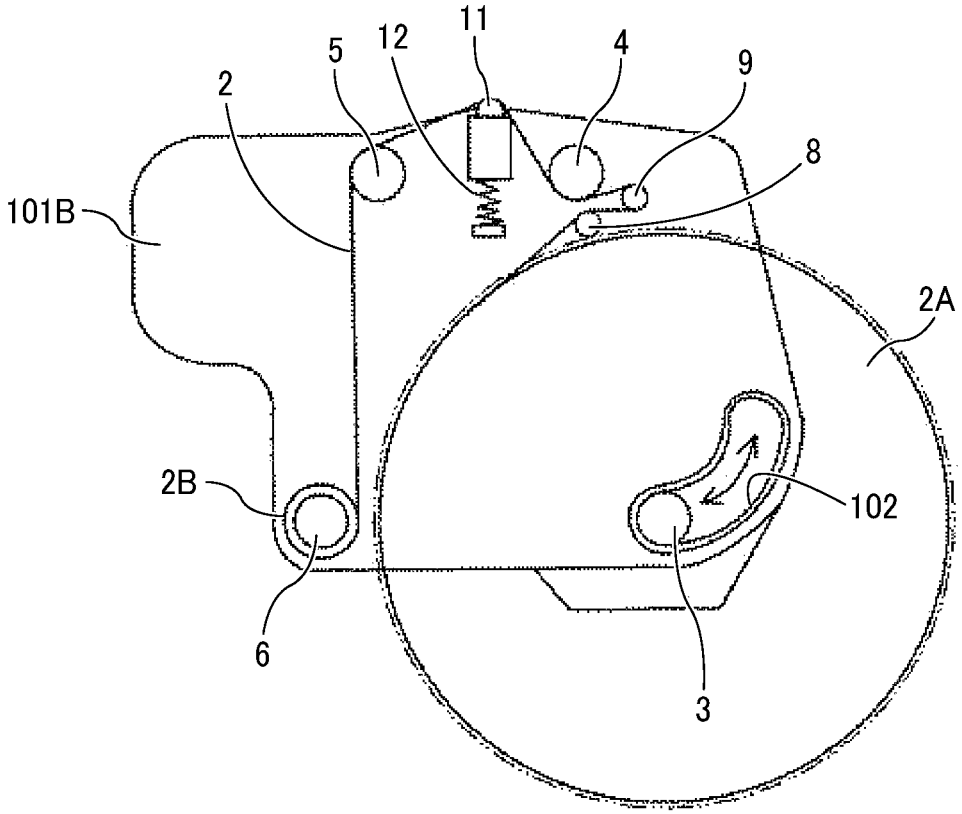
FIG. 4 an internal side view of the wiping cartridge of FIG. 3.
Figure 5A:
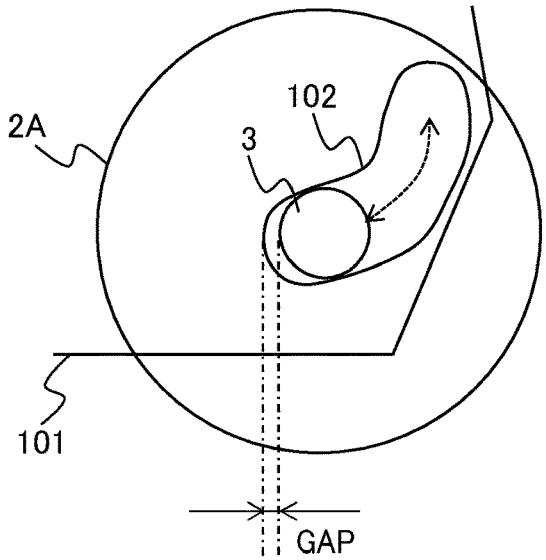
FIGS. 5A, 5B, and 5C are perspective views illustrating the principle by which a slack of the wiping member of the wiping cartridge of FIG. 3 is generated.
Figure 5B:
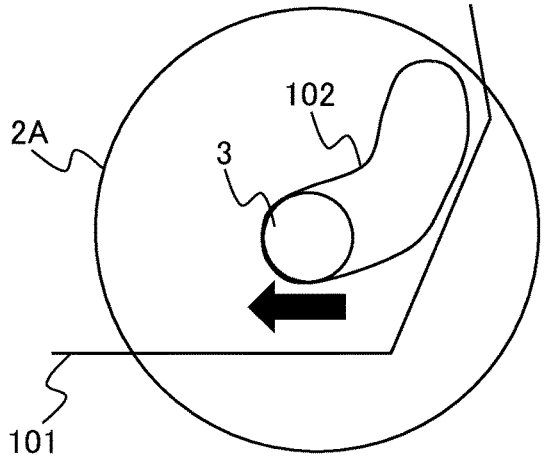

The "web slack" in the wiping cartridge 100 of the wiping device 1 is described with reference to FIGS. 3 to 5. FIG. 3 is an external perspective view of the wiping cartridge 100. FIG. 4 is an internal side view of the wiping cartridge 100. FIGS. 5A, 5*b*, and 5C are enlarged schematic views illustrating the web slack generated in the wiping cartridge 100.

A wiping cartridge 100 according to the present embodiment includes the feed roller 3 and the winding roller 6. The feed roller 3 is an axial member of the feed-side roll 2A on which the wiping member as a band-shaped member (sheet-shaped member) is wound in a roll shape. The winding roller 6 is the axial member of the winding-side roll 2B on which the web 2 fed from the feed-side roll 2A is wound. In the initial state, the web 2 is not wound on the winding roller 6. However, in order to clarify the description, FIG. 4 illustrates a state in which the winding-side roll 2B is formed, and the maximum outer diameter state of the feed-side roll 2A is illustrated by the two-dot chain line.

Preferably, the web 2 is made of a sheet-shaped material that has an absorption property and a liquid resistance to at least liquid to be used and is free of fluffing and generating dust. Examples of such a material include, but are not limited to, non-woven fabric, cloth, film, and paper.

The web 2 is fed from the feed-side roll 2A of the feed roller 3, passes through guide rollers 8 and 9 and conveying rollers 4 and 5, and is wound up by the winding roller 6 as the winding-side roll 2B. Here, the feed side of the feed-side roll 2A from which the web 2 is fed faces the winding side of the winding-side roll 2B to which the web 2 is wound.

The feed roller 3, the winding roller 6, the guide rollers 8 and 9, and the conveying rollers 4 and 5 are rotatably held by the cartridge case 101 of the wiping cartridge 100. The cartridge case 101 is dividable into two pieces of cartridge cases 101A and 101B.

The feed roller 3, which is one of the two axial members, i.e., the feed roller 3 and the winding roller 6, is movably held in a guide groove 102 formed in the cartridge case 101 so that the feed roller 3 is movable relative to the winding roller 6, which is the other of two axial members.

Here, the guide groove 102 is formed in a curved shape along which the feed roller 3 as one of the axial members can move obliquely upward while moving away from the winding roller 6 as the other axial member. By the shape of the guide groove 102, the feed roller 3 is initially moved to a lower end position of the guide groove 102 by the weight of the feed-side roll 2A, and the distance between the feed roller 3 and the winding roller 6 becomes the closest. That is, when the roll diameter of the feed roller 3 is relatively large, the positional relation with the winding roller 6, which is the other axial member, is such that the feed roller 3 is supported at a substantially horizontal position with respect to the winding roller 6 at a position at which the feed roller 3 is opposite to the winding roller 6.

The positional relation between the feed roller 3 and the winding roller 6 changes, as the web 2 is fed from the feed-side roll 2A, the roll diameter of the feed roller 3 decreases, and the weight of the feed roller 3 itself decreases. That is, in the positional relation in which the feed roller 3 is opposite to the winding roller 6, as the roll diameter of the feed roller 3 decreases, the interaxial distance between the feed roller 3 and the winding roller 6 increases (in other words, the feed roller 3 moves farther away from the winding roller 6). As a result, the feed roller 3 moves from the substantially horizontal position to an upwardly distant position along the shape of the guide groove 102.

Further, a pressing member 11 that presses the web 2 against the object to be wiped is disposed between the two conveying rollers 4 and 5. When the pressing member 11 presses the web 2 into contact with the object to be wiped, the spring 12 presses the web 2 against the object to be wiped with a predetermined pressing force. A code wheel 14 is attached to the conveying roller 4.

The wiping cartridge 100 is configured so as to reduce the interaxial distance for downsizing. Therefore, the wiping cartridge 100 includes a swinging mechanism for moving the feed roller 3 so as not to interfere with a supply web roll near the midpoint of the winding amount when a used web is wound by the winding shaft.

As illustrated in FIG. SA, when the wiping cartridge 100 moves to the position (wiping position) at which the operation (wiping) of wiping the nozzle surface 20*a* of the liquid discharge head 20 is performed, the feed roller 3 is movable by the gap. When the feed roller 3 moves to the initial position (home position) after the wiping cartridge 100 finishes the wiping of the nozzle surface 20*a*, as illustrated in FIG. 5B, the feed roller 3 moves in a direction of filling the gap. The moving direction of the feed roller 3 in moving to the home position is a direction relatively opposite to the moving direction of the wiping cartridge 100 due to the inertia to the feed roller 3.

Figure 5C:
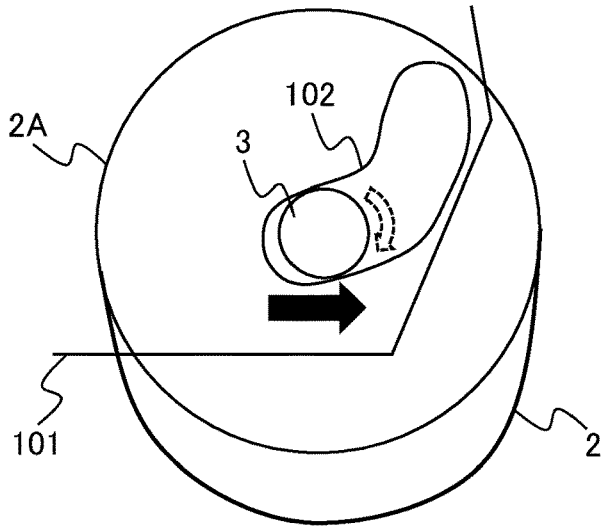

After that, when the wiping cartridge 100 reaches the home position and stops, the feed roller 3 moves due to the inertia in the direction in which the wiping cartridge 100 was moving (see FIG. 5C). At this time, the feed roller 3 is rotated by the inertia in the direction in which the web 2 is fed, so that the web 2 slacks. In this way, a "web slack" occurs.

In the normal wiping operation of the wiping device 1, a used web roll is wound immediately after the wiping operation is completed. Accordingly, even if the web slack is generated, the web slack is eliminated. On the other hand, since the wiping operation is not performed when the wiping cartridge 100 returns to the home position, the web slack occurs as illustrated in FIG. 5C. The amount of the web slack is accumulated through repeated operations.

The correlation between the speed difference and the web slack is supplementarily described with reference to the chart of FIG. 14. As a speed table for setting the moving speed of the wiping cartridge 100, the table illustrated in FIG. 15 is used.

The moving speed according to a comparative example is set to "130 mm/s (520 pps)" in the speed table illustrated in FIG. 15, and the moving speed according to the present embodiment is set to "50 mm/s (200 pps)". The acceleration according to the comparative example is set to "65 $m/s^2$ (elapsed time is 0.002 s)", and the acceleration according to the present embodiment is set to "10 $m/s^2$ (elapsed time is 0.005 s)".

Figure 14:
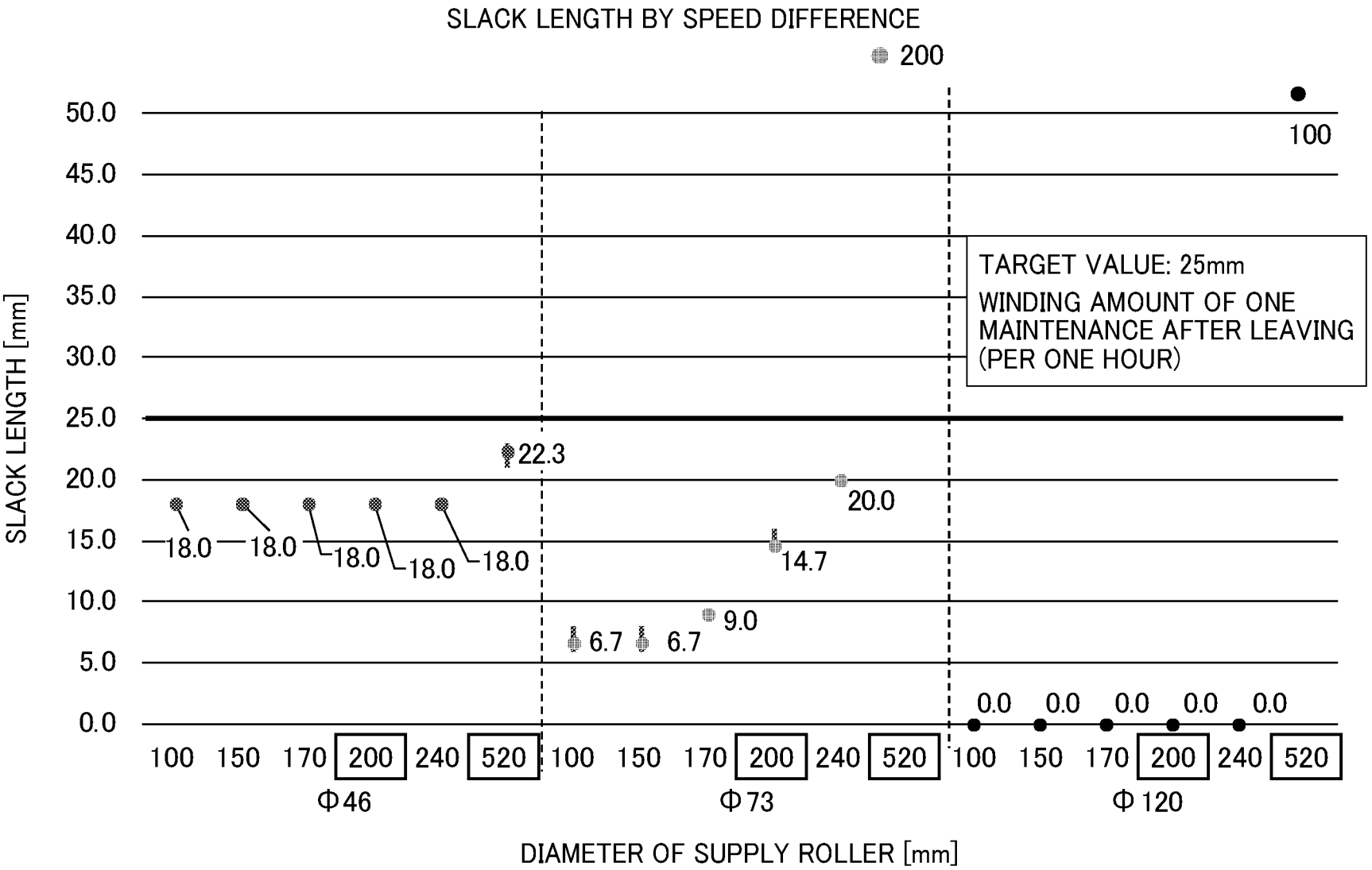
FIG. 14 is a chart illustrating an example of a slack amount generated in the wiping cartridge of FIG. 3.

As illustrated in the chart of FIG. 14, the length of the web slack (the slack length) varies depending on the diameter of the feed roll (the diameter on the side of the feed roller 3). Then, the "slack length" of the web 2 is shorter as the moving speed of the wiping cartridge 100 is slower. In the moving speed (520 pps) of the comparative example, the slack length of the web 2 is about 100 to 200 mm.

On the other hand, if the moving speed is slowed down, the slack length can be shorter. However, if the moving speed is 200 pps or less, vibration and sound are large. Therefore, considering slack prevention, vibration, and sound, 200 pps is preferable. Even if the moving speed is set to 200 pps, a slight web slack occurs (slack length is 18 mm).

The "target value of slack length: 25 mm" illustrated in FIG. 14 indicates the amount of winding in one maintenance after leaving.

First Embodiment

Figure 6A:
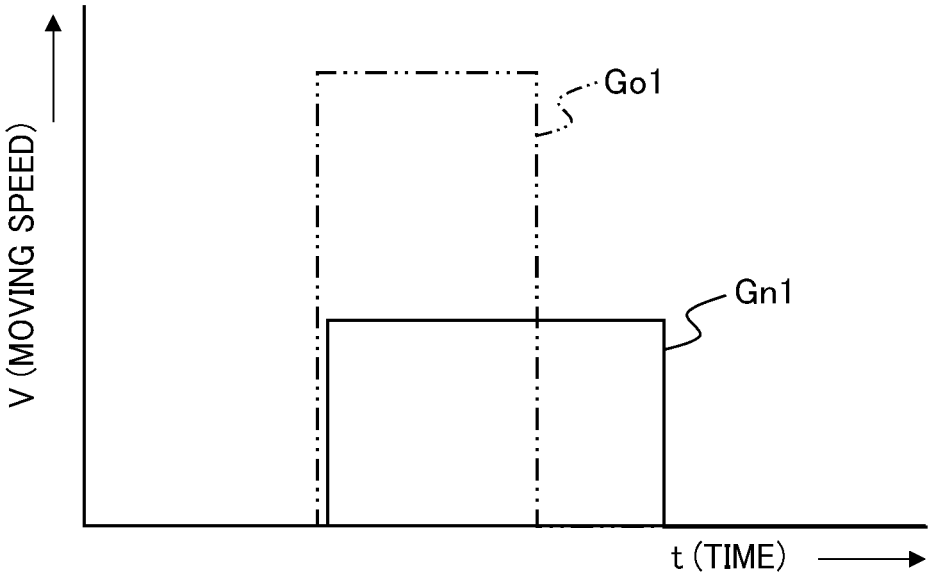
FIGS. 6A and 6B are diagrams illustrating examples of movement control of the wiping cartridge according to a first embodiment of the present disclosure.
Figure 6B:
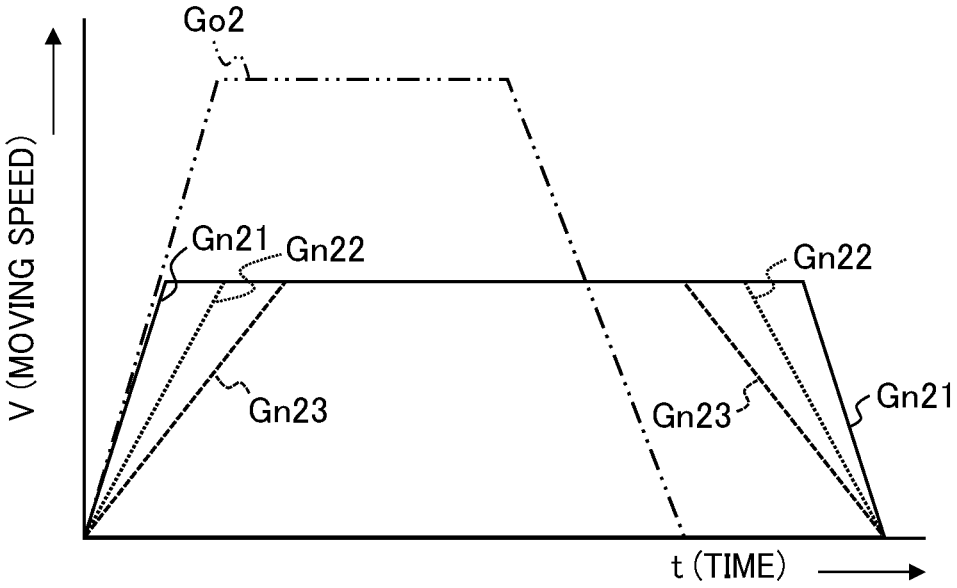

The controller 150 provided in the wiping device 1 according to the first embodiment performs the movement control of the wiping cartridge 100 so as to reduce the "web slack" as described above. FIGS. 6A and 6B are examples of the movement control of the wiping cartridge 100 according to the first embodiment, and are diagrams illustrating the change of the moving speed of the wiping cartridge 100 from the operation start time to the operation end time when the wiping operation is performed.

In FIG. 6A, the graph Go1 illustrates the control of the moving speed of the wiping cartridge 100 according to a comparative example. In order to reduce or prevent the web slack, the controller 150 controls the moving speed of the wiping cartridge 100, such as the graph Gn1, to a predetermined speed or less. Thus, the swinging of the feed roller 3 can be restrained, and the web slack can be prevented.

Further, as illustrated in FIG. 6B, the controller 150 controls the positive acceleration (acceleration) at the start of movement of the wiping cartridge 100 and the negative acceleration (deceleration) at the end of the movement so that the slope of the graph according to the first embodiment is gentler than the slope of the graph Go2 according to the movement control according to the comparative example. For example, the controller 150 performs the control with a plurality of stages such as a graph Gn21 having a slightly gentler acceleration and deceleration than the comparative example, a graph Gn22 having a gentler acceleration and deceleration, and a graph Gn23 having a further gentler acceleration and deceleration. Thus, the swinging of the feed roller 3 can be restrained, and the web slack can be prevented.

Second Embodiment

Next, the movement control of the wiping cartridge 100 according to the second embodiment of the present disclosure is described with reference to FIG. 7. The relation of "F=m×a" is satisfied, where the force with which the feed roller 3 on which the web 2 is wound starts to be moved by the inertia is "F (N)" and the mass of the feed roller 3 is "m (kg)", and the acceleration of the wiping cartridge 100 is "a ($m/s^2$)".

The relation of "F=μ×m×g" is established, where the force (moving force) required for the stationary feed roller 3 to start moving is "F' (N)", the friction coefficient of the shaft of the feed roller 3 is "μ", and the gravitational acceleration is "g ($m/s^2$)".

Based on the above equation, the controller 150 performs control of the moving speed of the wiping cartridge 100 so that the relation of "F<G'" is satisfied.

Figure 7:
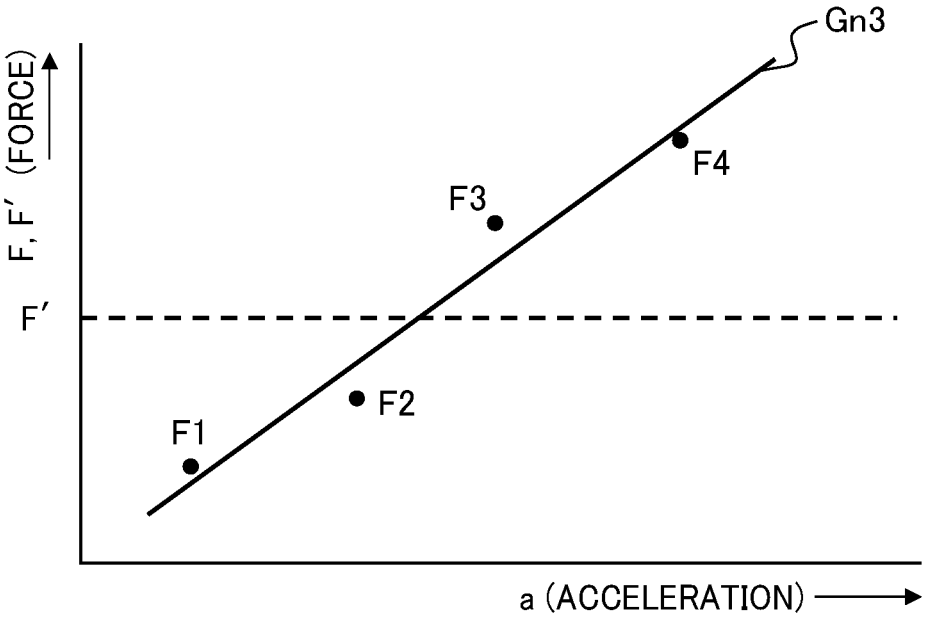
FIG. 7 is a diagram illustrating an example of movement control of the wiping cartridge according to a second embodiment of the present disclosure.

FIG. 7 is a diagram illustrating the correlation between the force "F" (moving force) with which the feed roller 3 on which the web 2 is wound starts to be moved by the web 2 and the acceleration "a" of the wiping cartridge 100. As illustrated in the graph Gn3 in FIG. 7, "F" and "a" have a positive correlation. The controller 150 controls the acceleration "a" of the wiping cartridge 100 so that the force "F" is smaller than the force "F'" for the stationary feed roller 3 to start moving. Thus, the movement of the feed roller 3 due to the inertia can be restrained, and the web slack can be prevented. That is, twisting and winding failure of the web 2 can be prevented.

Third Embodiment

Figure 8A:
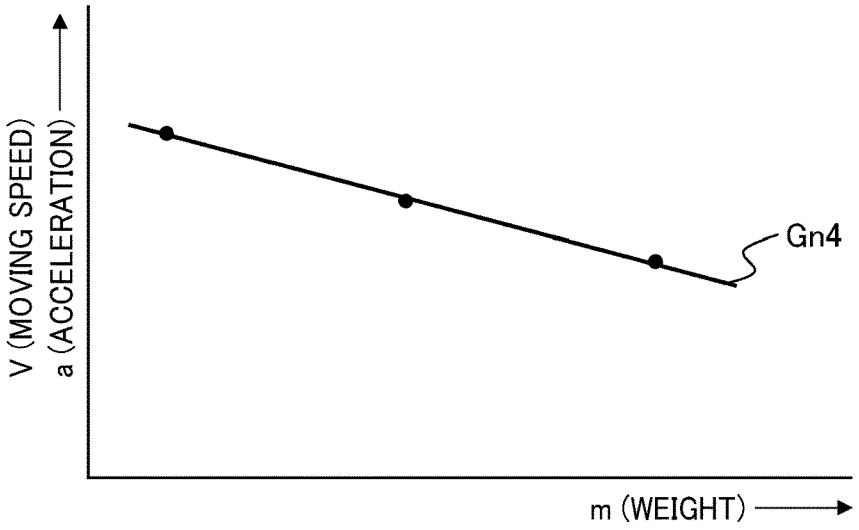
FIGS. 8A, 8B, and 8C are diagrams illustrating examples of movement control of the wiping cartridge according to a third embodiment of the present disclosure.

Next, the movement control of the wiping cartridge 100 according to the third embodiment is described with reference to FIGS. 8A, 8B, and 8C. As described above, the wiping cartridge 100 provided in the wiping device 1 includes an encoder sensor 15 consisting of a transmissive photo sensor that detects the pattern formed on the code wheel 14. The encoder 16 that detects the moving distance (feed amount) of the web 2 is configured by these code wheel 14 and an encoder sensor 15.

The controller 150 calculates the mass of the feed roller 3 from the amount of the web 2 remaining on the feed roller 3 based on the feed amount of the web 2 detected by the encoder 16. The mass of the feed roller 3 affects the negative acceleration (deceleration) of the feed roller 3. As illustrated in FIG. 8A, there is a negative correlation between the mass "m" of the feed roller 3 and the moving speed "V" and the acceleration "a".

Figure 8B:
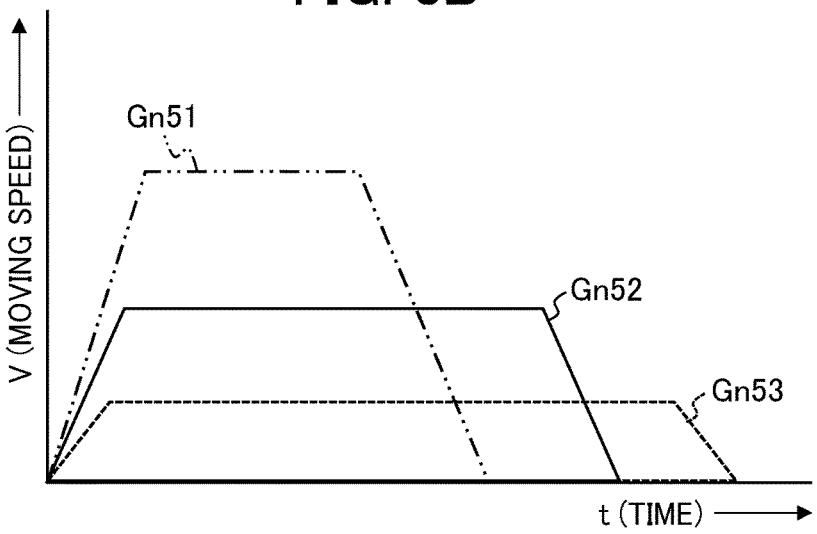

As illustrated in FIG. 8B, the relation between the time from the start to the stop of movement of the wiping cartridge 100 and the moving speed is different depending on the amount of the mass "m" of the feed roller 3. That is, in FIG. 8B, comparing the graph Gn51 of a case in which the mass "m" is small, the graph Gn53 of a case in which the mass "m" is large, and the graph Gn52 of a case in which the mass "m" is intermediate, the smaller the mass "m", the less the web slack occurs even if the moving speed is increased. On the other hand, when the mass "m" is large, the moving speed is slowed to reduce the occurrence of web slack.

Figure 8C:
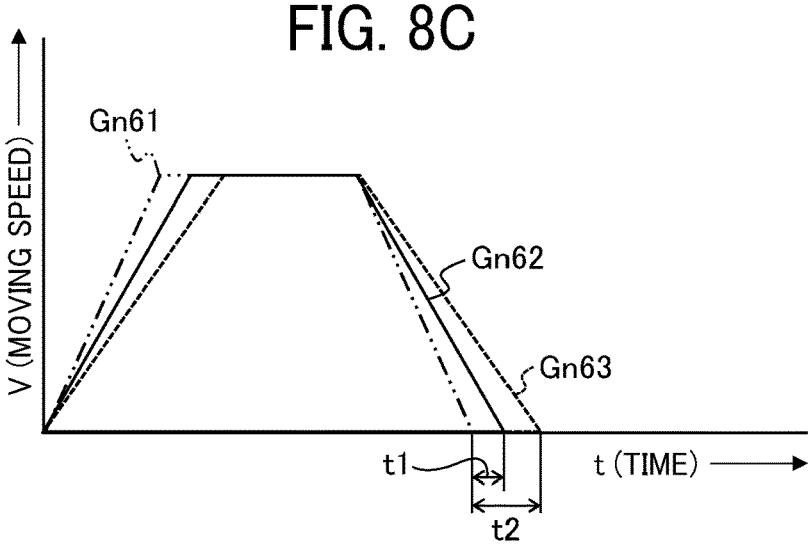

As illustrated in FIG. 8C, the acceleration and deceleration may be adjusted by keeping the moving speed of the wiping cartridge 100 constant, regardless of the mass "m" of the feed roller 3. For example, when the mass "m" is low, the web slack can be reduced, as illustrated in the graph Gn61 in FIG. 8C, even if the acceleration and the deceleration are set to steep inclination. In this case, the movement time is shortened by a time t1 as compared to the graph Gn62 in FIG. 8C when the mass "m" is intermediate. In contrast, as compared to the graph Gn63 of a case in which the mass "m" is large, the movement time is shortened by a time t2.

As described above, the wiping device 1 according to the third embodiment can prevent twisting and winding failure of the web 2 while reducing the movement time of the wiping cartridge 100 for the purposes such as increasing productivity.

Fourth Embodiment

Next, the movement control the wiping cartridge 100 according to the fourth embodiment of is described with reference to FIGS. 9A, 9B, and 9C. In the movement control of the wiping cartridge 100, the controller 150 can also set the acceleration and the deceleration to different slopes in the acceleration stage after the movement starts and the deceleration stage before the movement stops.

Figure 9A:
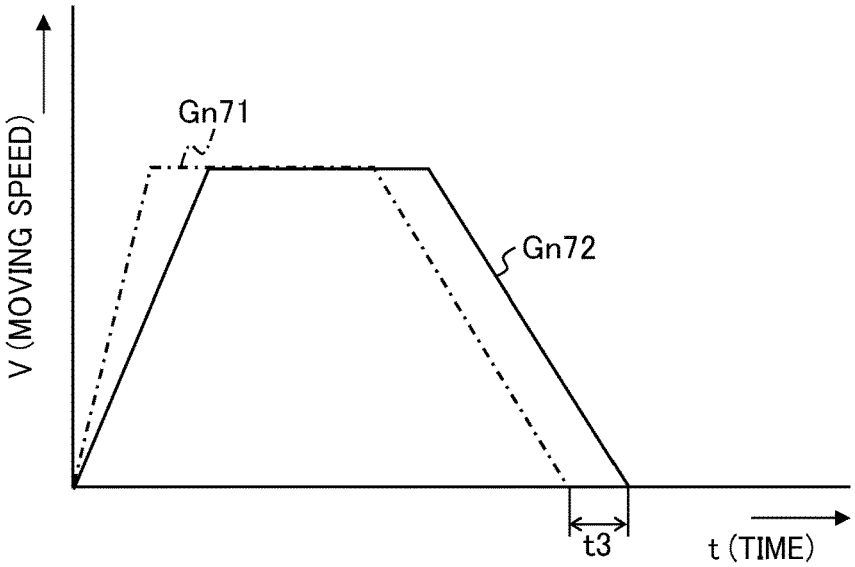
FIGS. 9A, 9B, and 9C are diagrams illustrating examples of movement control of the wiping cartridge according to a fourth embodiment of the present disclosure.

For example, as illustrated in the graph Gn71 illustrated in FIG. 9A, the controller 150 controls the acceleration slope to be steep to shorten the time to reach the moving speed and the deceleration slope to be gentle so that the swinging of the feed roller 3 is restrained.

Figure 9B:
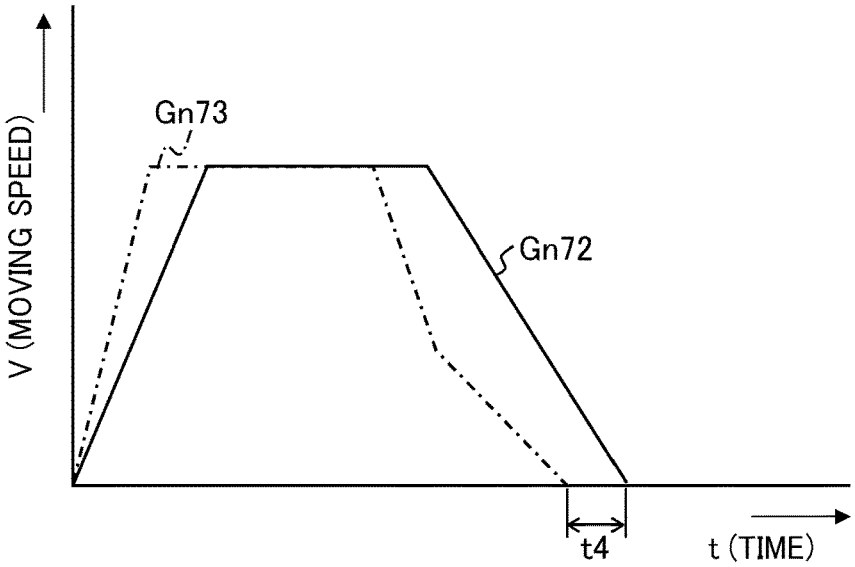
Figure 9C:
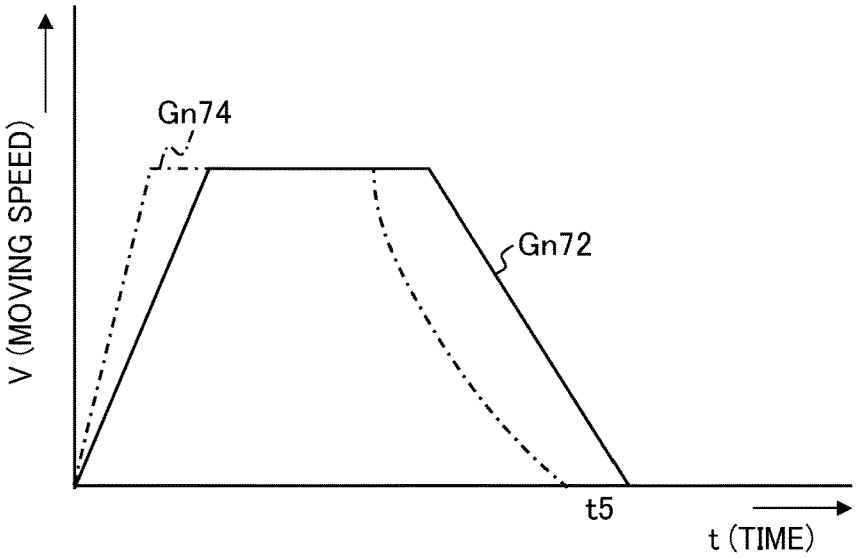

As illustrated in FIGS. 9B and 9C, the slope of the deceleration may be formed of a combination of a plurality of decelerations or may be controlled so that the change of the deceleration is curved.

As illustrated in FIGS. 9A, 9B, and 9C, controlling the moving speed of the wiping cartridge 100 can prevent twisting and winding failure of the web 2 while reducing the movement time of the wiping cartridge 100 for purposes such as increasing productivity.

Fifth Embodiment

Next, the movement control of the wiping cartridge 100 according to the fifth embodiment is described with reference to FIG. 10. In the movement control of the wiping cartridge 100, the controller 150 may control the movement control related to the forward direction and the movement control related to the return direction differently.

Figure 10:
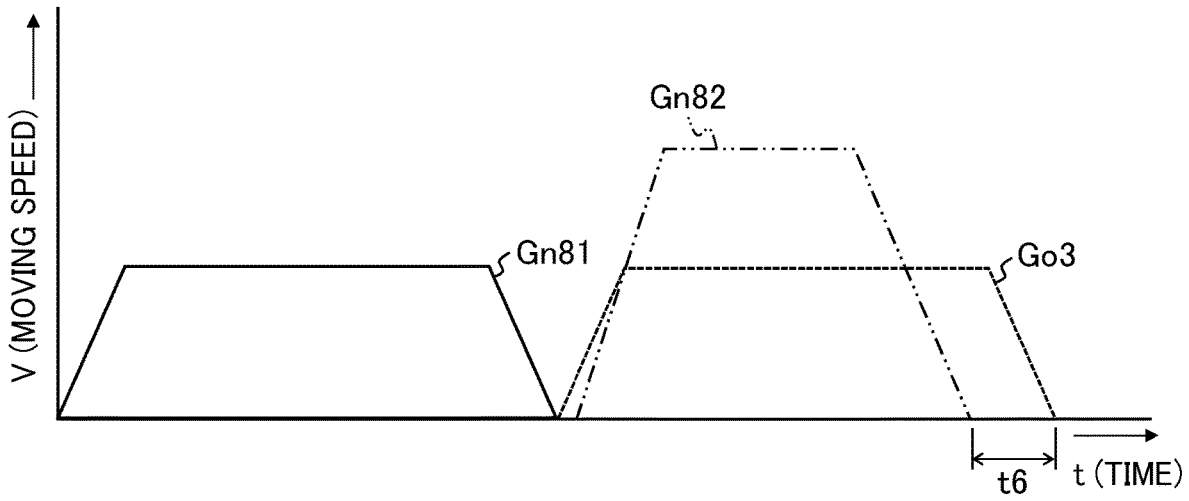
FIG. 10 is a diagram illustrating an example of movement control of the wiping cartridge according to a fifth embodiment of the present disclosure.

When the controller 150 controls the moving speed related to the movement only on the forward direction as illustrated in the graph Gn81 of FIG. 10, the controller 150 controls the moving speed related to the movement on the return direction as illustrated in not the graph Go3 but the graph Gn82 of FIG. 10. That is, in the reciprocating movement of the wiping cartridge 100, the moving speed of only the forward direction (only one direction) is set to the predetermined speed or less. Such movement control can enhance the productivity of the wiping operation by the reciprocating movement of the wiping cartridge 100 while reducing the occurrence of a web slack by slowing down the moving speed in the moving direction in which a web slack occurs.

Sixth Embodiment

Figure 11A:
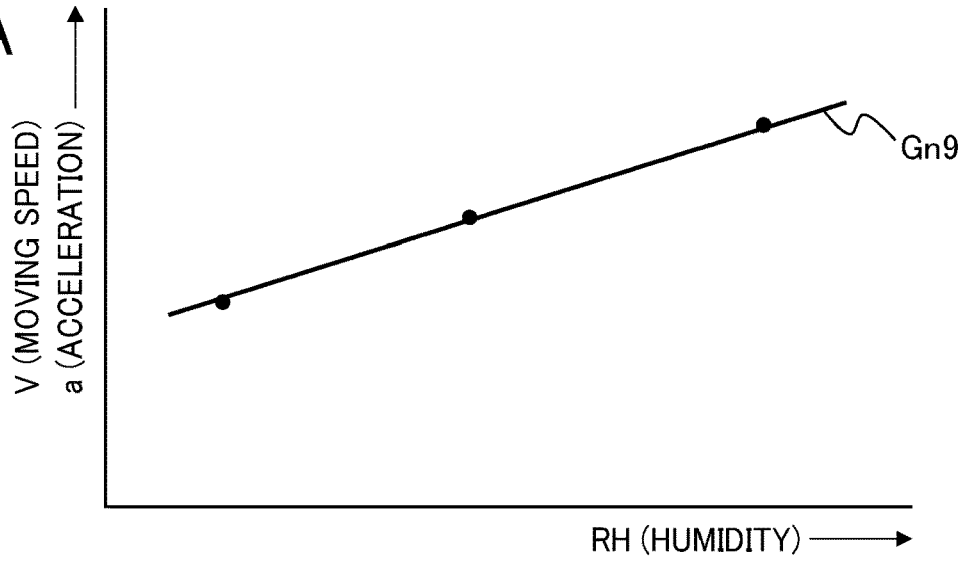
FIGS. 11A, 11B, and 11C are diagrams illustrating an example of movement control of the wiping cartridge according to a sixth embodiment of the present disclosure.

Next, the movement control of the wiping cartridge 100 according to the sixth embodiment is described with reference to FIGS. 11A, 11B, and 11C. The controller 150 provided in the wiping device 1 includes the humidity sensor 120 that measures the environmental humidity of the wiping cartridge 100 as described above. As illustrated in FIG. 11A, the moving speed "V" and acceleration "a" of the feed roller 3 due to the movement of the wiping cartridge 100 have a positive correlation with the relative humidity "RH".

Figure 11B:
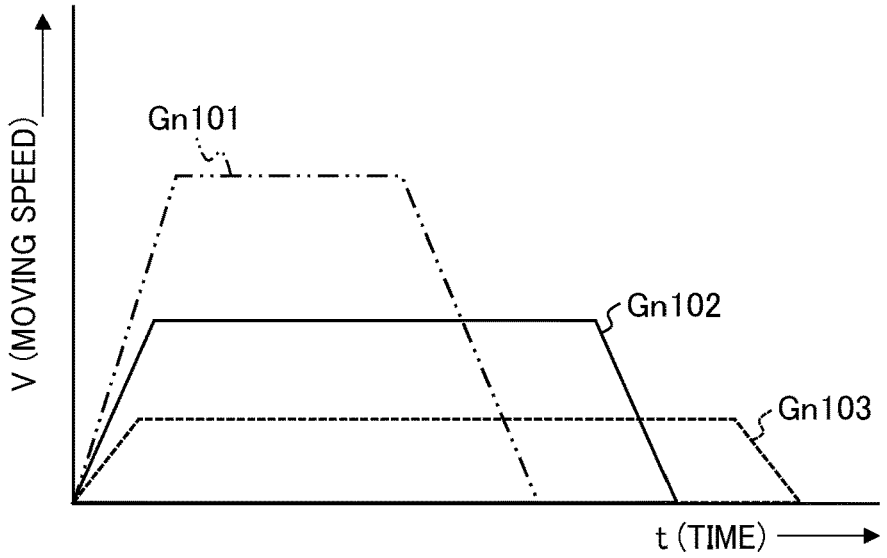
Figure 11C:
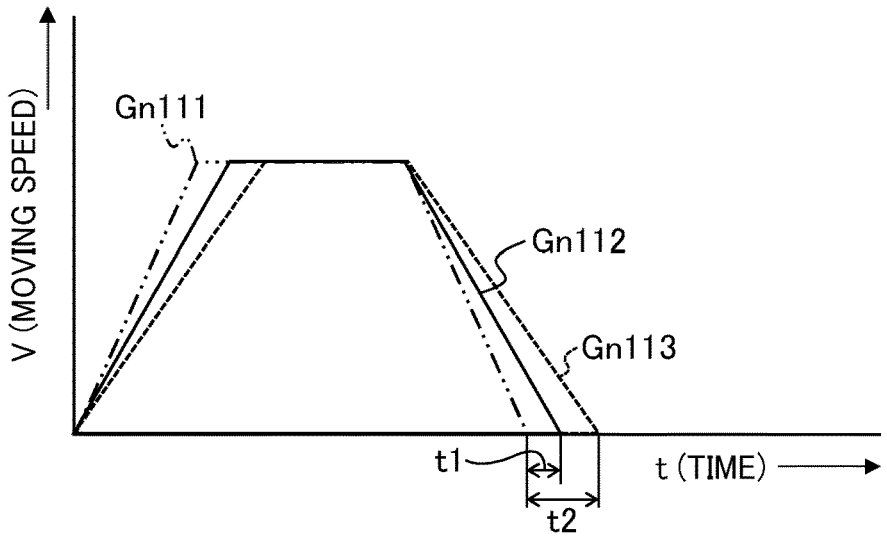

Therefore, when the humidity measured with the humidity sensor 120 is low, the controller 150 performs the movement control of the wiping cartridge 100 so that both the acceleration and deceleration have a steep slope and the moving speed is faster, as illustrated in the graph Gn101 in FIG. 11B. On the other hand, when the humidity is high, the controller 150 performs the movement control so that the slopes of the acceleration and deceleration are gentle, as illustrated in the graph Gn103 of FIG. 11B, and the moving speed is slower. When the humidity is intermediate, the controller 150 performs the movement control of the wiping cartridge 100 as illustrated in the graph Gn102 of FIG. 11B.

The controller 150 performs the movement control of the wiping cartridge 100 so as to change the slopes of the acceleration and deceleration based on the measurement result of the humidity sensor 120, while maintaining the moving speed of the wiping cartridge 100 constant. For example, when the humidity is high, the slopes of the acceleration and deceleration are set to be steep as illustrated in the graph Gn111 of FIG. 11C. On the other hand, when the humidity is low, the slopes of the acceleration and deceleration are set to be gentle as illustrated in the graph Gn113 of FIG. 11C. As described above, in the movement control in the case in which the humidity is high, the movement time is shortened by the time t1 as compared with the graph Gn112 in the case in which the humidity is intermediate. Compared with the graph Gn113 in the case in which the humidity is low, the movement time is shortened by only the time t2.

As described above, the movement control of the wiping device 1 according to the sixth embodiment allows the moving speed, the acceleration speed, and the deceleration speed of the wiping cartridge 100 to vary according to the humidity, thus allowing the moving speed to vary optimally according to the operating environment. Thus, twisting and winding failure of the web 2 can be prevented while the movement time can be reduced.

Further, the wiping device 1 according to the sixth embodiment is also effective in a case in which, when material of the axial member (or shaft core) of the web roll is changed from resin to paper for the purpose of cost reduction, the axial member made of paper contains moisture and the slidability of the wiping cartridge 100 with the swing groove deteriorates. That is, in the high humidity, the wiping device 1 can be controlled so as to increase the moving speed, the acceleration speed, and deceleration speed. Varying the moving speed according to the humidity can shorten the movement time and prevent twisting and winding failure of the web 2.

Embodiments of Head Maintenance Device and Liquid Discharge Apparatus

Figure 12:
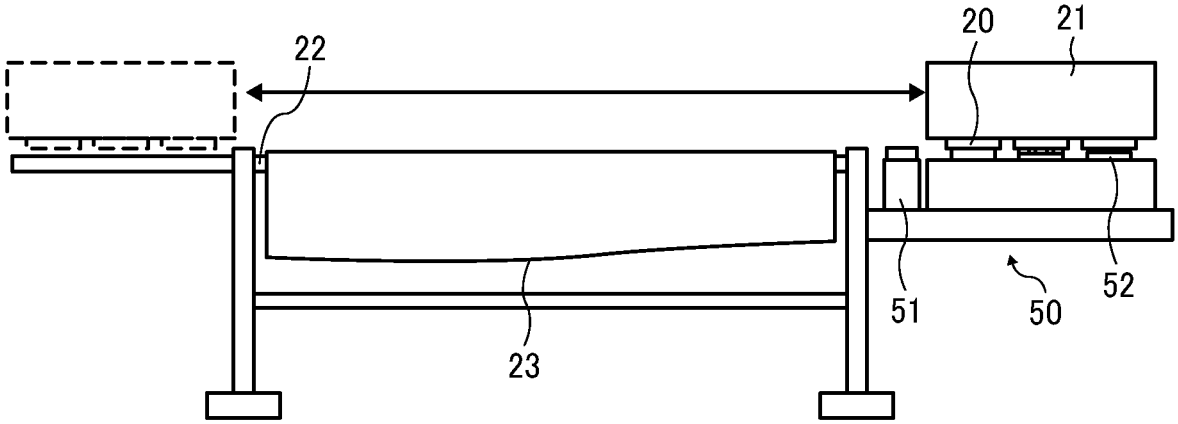
FIG. 12 is a front view illustrating a liquid discharge apparatus including a head maintenance device according to an embodiment of the present disclosure.
Figure 13:
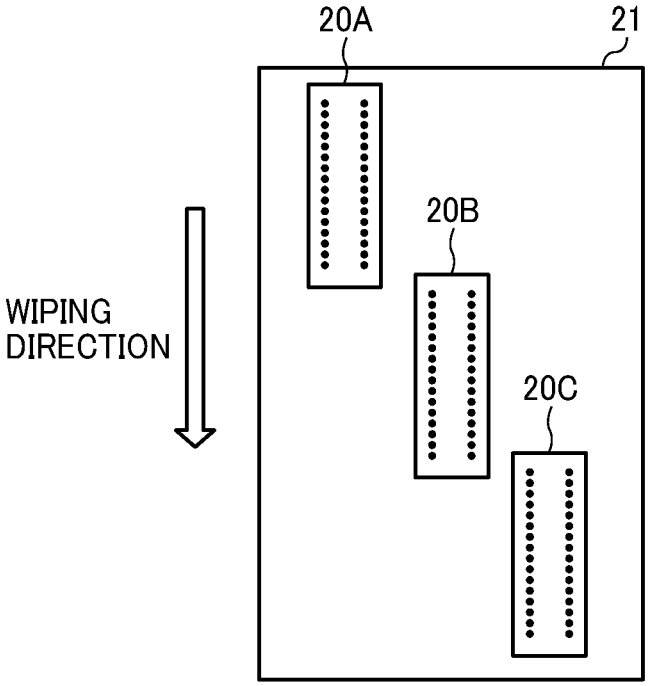
FIG. 13 is a plan view illustrating an arrangement of liquid discharge heads in a wiping carriage of the liquid discharge apparatus of FIG. 12.

Next, a description of a liquid discharge apparatus including a head maintenance device according to an embodiment of the present disclosure is described with reference to FIGS. 12 and 13. FIG. 12 is a front view of the liquid discharge apparatus according to the present embodiment. FIG. 13 is a plan view illustrating a head arrangement of a carriage of the liquid discharge apparatus.

The liquid discharge apparatus is a serial type apparatus. One or more liquid discharge heads 20 (20A to 20C) are mounted on a carriage 21, and a medium 23 is conveyed intermittently with a conveyor 22. The carriage 21 is reciprocatingly moved in the direction indicated by arrow in FIG. 12, and the liquid discharge heads 20 discharge desired liquid onto the medium 23 to form an image on the medium 23.

Further, a maintenance device 50 that performs maintenance (head maintenance) of the liquid discharge heads 20 is disposed on the home position side of the carriage 21. The maintenance device 50 includes caps 52 to cap nozzle surfaces 20*a* of the liquid discharge heads 20 and a head cleaning device 51 including the wiping device 1 according to any of the first to sixth embodiments as described above.

As described above, the maintenance device including the wiping device according to any embodiment of the present disclosure can clean the head surfaces to perform stable liquid discharge and can downsize the maintenance device.

In the above-described embodiments, the wiping cartridge 100 as a roll unit using a wiping member such as a web as a band-shaped member, the wiping device 1 as a roll device, the maintenance device 50, and the liquid discharge apparatus are described. However, the band-shaped member is not limited to the wiping member. For example, the band-shaped member may be applied to a roll unit or a roll device using a rolled sheet.

In other words, the object that is wound on the feed-side roll and the winding-side roll is not limited to only the web. The object may be any roll-shaped material (band-shaped member) such as a paper material as a roll sheet of paper, a label, a tape, or a fabric used for clothing.

The thickness and material of the band-shaped member are not limited. A conveyance (creeping) route of the band-shaped member and the arrangement of the roll can be appropriately changed according to the uses of the roll unit and the roll device.

In consideration of the ease of moving the roll, the above-described embodiments of the present discourse are particularly effective for products in which the gross mass of the band-shaped member wound as the feed-side roll is small.

Embodiments of the present disclosure are not limited to the specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The invention claimed is:

1. A wiping device comprising:

a roll assembly including:

a band-shaped wiper;

a first axial roller on which the band-shaped wiper is wound around in a roll shape to form a feed-side roll;

a second axial roller on which the band-shaped wiper fed from the feed-side roll is wound around in a roll shape to form a winding-side roll, the first axial roller being movable relative to the second axial roller;

a mover to slide the roll assembly;

processing circuitry configured to control sliding of the roll assembly; and a groove to:

support the first axial roller at a position substantially horizontally opposed to the second axial roller when a diameter of the feed-side roll is equal to or larger than a size; and guide the first axial roller so that the first axial roller moves upward and farther away from the second axial roller as the diameter of the feed-side roll decreases from the size.

2. The wiping device according to claim 1, further comprising a guide roller to feed the band-shaped wiper fed from the feed-side roll, more upward than the feed-side roll.

3. The wiping device according to claim 1, wherein the processing circuitry is configured to control a moving force F with which the feed-side roll moves to swing and a required force F' by which the feed-side roll is moved from a stationary state so that a relation of $F<F'$ is satisfied.

4. The wiping device according to claim 1, wherein the processing circuitry is configured to control a moving speed of the roll assembly so that a slope of a negative acceleration at a stop of movement of the feed-side roll is smaller than a slope of a positive acceleration at a start of movement of the feed-side roll.

5. The wiping device according to claim 1, wherein the processing circuitry is configured to control a moving speed of the roll assembly in only one direction in the sliding of the roll assembly to be slower than a predetermined speed.

6. The wiping device according to claim 1, further comprising a humidity sensor to measure humidity around the roll assembly, wherein the processing circuitry is configured to control a moving speed of the roll assembly so that the moving speed varies according to the humidity measured with the humidity sensor.

7. A head maintenance device configured to maintain a liquid discharge head, the head maintenance device comprising the wiping device according to claim 1 configured to wipe a nozzle surface of the liquid discharge head.

8. A liquid discharge apparatus comprising:

a liquid discharge head configured to discharge a liquid; and the head maintenance device according to claim 7.

* * * * *